United States Patent [19]

Fraser

[11] 4,395,881

[45] Aug. 2, 1983

[54] STIRLING ENGINE POWER CONTROL

[75] Inventor: James P. Fraser, Scotia, N.Y.

[73] Assignee: Mechanical Technology Incorporated, Latham, N.Y.

[21] Appl. No.: 234,741

[22] Filed: Feb. 17, 1981

[51] Int. Cl.[3] ..... F02G 1/044; F02G 1/045; F02G 1/05

[52] U.S. Cl. ..... 60/521; 60/517; 60/525

[58] Field of Search ..... 60/517, 522, 524, 525, 60/521

[56] References Cited

U.S. PATENT DOCUMENTS

| | | | |
|---|---|---|---|
| 3,457,722 | 7/1969 | Bush | 60/522 |
| 3,527,049 | 9/1970 | Bush | 60/524 |
| 3,724,206 | 4/1973 | Ross | 60/521 |
| 3,756,018 | 9/1973 | Hakansson | 60/522 |
| 4,030,297 | 6/1977 | Kantz et al. | 60/522 |
| 4,327,550 | 5/1982 | Knöös | 60/522 |

*Primary Examiner*—William R. Cline
*Assistant Examiner*—John M. Kramer
*Attorney, Agent, or Firm*—Joseph V. Claeys; Arthur N. Trausch, III

[57] ABSTRACT

A power control method and apparatus for a Stirling engine including a valved duct connected to the junction of the regenerator and the cooler and running to a bypass chamber connected between the heater and the cylinder. An oscillating zone of demarcation between the hot and cold portions of the working gas is established in the bypass chamber, and the engine pistons and cylinders can run cold.

14 Claims, 3 Drawing Figures

STIRLING ENGINE POWER CONTROL

The Government of the United States of America has rights in this invention pursuant to Contract No. DEN3-32 awarded by the United States Department of Energy.

BACKGROUND OF THE INVENTION

This invention relates to a power control for an externally fired heat engine, and more particularly to a Stirling engine power control.

The Stirling engine is a high efficiency power source which is quiet and reliable. It has an external combustor which can use any heat producing fuel source and can be adjusted for low undesirable combustion emissions. Because the Stirling engine solves so many problems which have remained unsolved in the internal combustion engine, it has been the subject of intense development effort in recent years.

Much improvement has been made in Stirling engine technology and this engine is now approaching the stage at which it will be considered for production development in the numerous applications for which it is ideally adapted. However, before this stage can be reached several problems remain to be solved. These include power control, heat conduction losses, and cost. The power control problem is one which has received much attention and in which great strides have been taken. However, the existing power controls which have been proven and adopted for use are discontinuous in operation or are expensive and complicated and would present a difficult maintenance and service prospect to the average serviceman. In addition to simplicity and low cost, an acceptable practical power control must also provide a fast response time and introduce little or no losses to the engine cycle which would reduce engine efficiency.

Heat conduction loss in the Stirling engine has been a serious problem which has received little attention. The advantage of an isothermal expansion space in the Stirling cycle becomes a liability if a heat conduction path to the cooler permits a significant loss of heat.

The high cost of prior art Stirling engines is partly a consequence of the need to operate the expansion space at very high temperatures. In order to achieve high efficiency, the difference in temperature between the expansion and compression spaces must be as high as possible. However, this requirement imposes severe penalties on the portions of the mechanism which must operate at high temperature such as the piston dome, piston rings, cylinder head, and related seals and connections. The need to operate these components at high temperatures imposes a severe environmental condition on the engine, and the solutions necessary to enable the engine to operate under these conditions are expensive.

Accordingly, a significant advance in the technology of Stirling engines would be achieved by providing a power control apparatus which is simple, reliable, fast acting, and inexpensive, and by incorporating this power control in a system which enables the expansion space to be thermally isolated from the other parts of the engine.

SUMMARY OF THE INVENTION

Accordingly, it is an object of this invention to provide a Stirling engine power control which gives continuous power control from zero to full power by the use of a simple, inexpensive and reliable device. The power control may be incorporated into a system that enables separation of the hot and cold portions of the engine to minimize conduction heat losses from the heater to the cooler. The moving portion of the engine and the cylinder heads may be maintained cold to simplify the design and lower the cost of the engine.

These objects are achieved in a preferred embodiment of the invention having a bypass chamber connected between the heater and the engine cylinder and in which an oscillating zone of demarcation is established between the hot and cold working gas. A valved duct is provided between the junction of the regenerator and cooler and the bypass chamber to permit working gas to be diverted around the regenerator and heater into the cylinder so that heat input into the working gas, and therefore engine power, is reduced.

DESCRIPTION OF THE DRAWINGS

The invention and its many attendant objects and advantages will become more clear upon reading the following description of the preferred embodiment of the invention when read in conjunction with the following drawings, wherein.

DESCRIPTION OF THE PREFERRED EMBODIMENTS

Figure 1:
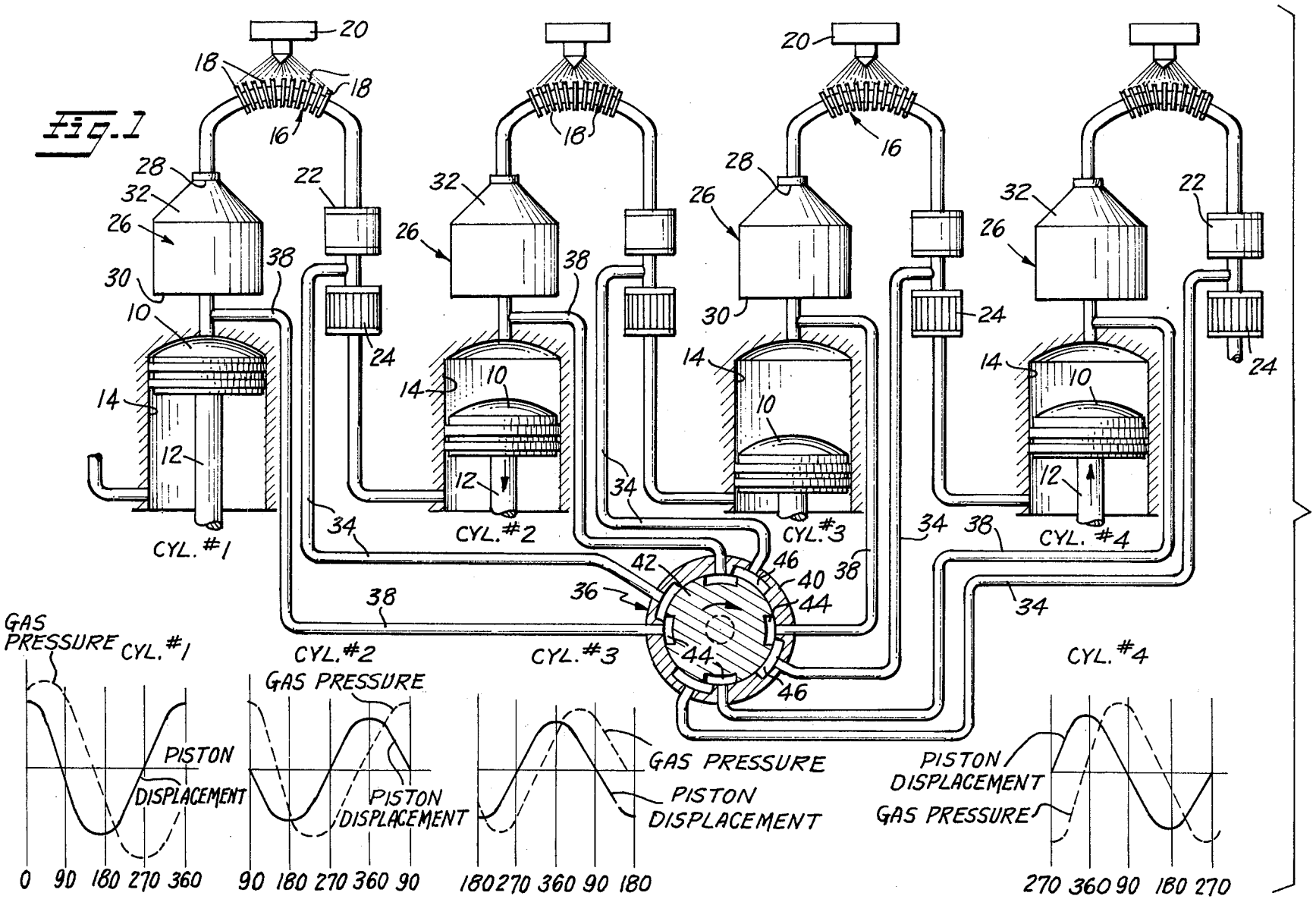
FIG. 1 is a schematic view of a Siemens double-acting Stirling engine incorporating a power control according to this invention, and showing a graph of the piston displacement and working gas pressure for each of the four cylinders in the engine.

Referring now to the drawings, wherein like reference characters designate identical or corresponding parts, and more particularly to FIG. 1 thereof, a schematic diagram of a double-acting Stirling engine is shown having four cylinders 14 each containing a piston 10 connected by a piston rod 12 to a reciprocating-to-rotating motion conversion device such as a crankshaft (not shown) or a wobble plate mechanism (not shown). The pistons 10 oscillate with reciprocating axial motion in the cylinders 14 which may be formed in an engine block or may be a cylinder liner contained within a water jacket. As noted below, the invention may obviate the need for water cooling of the cylinders.

A heater 16 is provided for heating an engine working gas such as hydrogen during a portion of the Stirling cycle. The heater 16 is a section of high temperature tubing having heating fins 18 which transfer heat from a combustor 20 to the tubing and thence to the gas flowing in the tubing. The heater 16 is connected to a regenerator 22 which can be, for example, a stack of wire screens formed of high temperature material such as Inconel X-750. The lower end of the regenerator 22 is connected to a cooler 24 in the form of a large number of fine tubes brazed between two apertured plates and around which circulates the water to cool the gas flowing through the tubes. A more complete description of the cooler and regenerator in this embodiment is disclosed in the prior copending patent application Ser. No. 168,075, of Folsom and Dineen filed on July 14, 1980, now U.S. Pat. No. 4,350,012.

The bottom end of the cooler 24 is connected to a lower end of the adjacent cylinder No. 2, and the lower end of the cylinder No. 1 is connected to the cooler of cylinder No. 4, in the known arrangement of a double-acting Siemens Stirling engine, as set forth in the literature, for example, in U.S. Pat. No. 4,069,671 issued on Jan. 24, 1978, to Berntell, and U.S. Pat. No. 3,802,197 issued to Gothberg on Apr. 9, 1974. Thus, the working space No. 1 is defined as the volume of cylinder No. 1 above the piston and the volume of cylinder No. 2 below its piston, and the dead volume of the heat exchangers connecting the two spaces. Each of the cylinders is connected in this manner and each of the pistons is connected to the crankshaft or other reciprocating-to-rotating motion conversion mechanism such as the wobble hub disclosed in the copending application of John J. Dineen for "Stirling Engine Control Mechanism and Method" filed on Jan. 26, 1981, Ser. No. 228,457, now U.S. Pat. No. 4,372,116. The phase relationship between the adjacent pistons is 90° and the piston in the cylinder containing the compression space leads the piston in the cylinder containing the expansion space by 90°. Each of the pistons is connected in this manner. A pressure wave is generated which lags the piston in the expansion space by 60° so that the pressure forces are greatest when the crank angle of the motion conversion mechanism produces the longest effective moment arm over the high pressure portion of the gas pressure wave in the expansion space. When power must be returned from the engine by compressing the gas, it is accomplished at low pressure so that net output work is produced.

A bypass chamber 26 is positioned between the heater 16 and the top of the cylinder 14. The bypass chamber 26 has a hot end 28 connected to the heater 16 and a cold end 30 connected to the top of the cylinder 14. A flow straightening device 32 is provided in each end of the bypass chamber 26 to ensure that the gas flow into the bypass chamber from either direction is laminar to minimize mixing of hot gas from the heater 16 with cold gas in the cylinder 14.

A gas conduit 34 leads from the junction of the regenerator 22 and the cooler 24 to a rotary throttling compound valve 36. A second gas conduit 38 leads from the rotary valve 36 to the junction of the bypass chamber 26 and the top end of the cylinder 14. A similar pair of gas conduits is provided for each of the other three cylinders in the double-acting engine illustrated.

The valve 36 includes a housing 40 and an internal element 42 rotatable relative to the housing 40. The valve 36 has four identical quadrants, one for each of the working spaces. Each quadrant includes a recess 44 on the external surface of the valve element 42 and a similar recess 46 on the internal surface of the valve housing 40. The gas conduit 34 is connected to the recess 46 and the gas conduit 38 is connected to the recess 44 so that the gas flow communication can be established between the two sections of the gas conduit by selective positioning of the valve element 42. In addition, the gas flow between the two sections of the gas conduit 34 and 38 can be throttled by the degree of overlap of the two recesses 44 and 46 in the valve so that the amount of gas flowing through the valve between the conduit section 34 and 38 can be controlled by the position of the valve element 42.

This valve 36 permits the simultaneous and uniform distribution of gas flow through and around the heater, but other valve configurations may also be used. For example, "digital" valves cycling between full open and full closed on a variable duty cycle could be used, and separate, simultaneously controlled throttling valves can also be used.

The operation of the power control can now be described. When it is desired to operate the engine at full power, the valve 36 is closed so that the gas flow between the conduit sections 34 and 38 is shut off and all the gas flowing between the top of the cylinder of No. 1 and the bottom of cylinder No. 2 must pass through the heater 16. Thus, maximum energy is transferred from the combustor 20 to the gas and thence transformed into mechanical work by the Stirling cycle. When it is desired to operate the engine at a reduced power level, the valve element 42 is positioned to permit a certain proportion of the working gas flowing between the adjacent cylinders to bypass the regenerator 22 and the heater 16 and thus flow directly from the cooler 24 into the top of the cylinder 14. The proportion of gas thus bypassing the regenerator and heater reduces the amount of heat added to the gas by decreasing the proportion of gas heated and thereby reduces the energy available to be converted by the Stirling cycle into mechanical work.

The bypass chamber 26 is designed to inhibit thermal mixing of the cool gas which bypasses the heater and the hot gas which flows through the regenerator and the heater. The chamber can be conical, with the apex at the hot end which minimizes swirling and other currents in the gas volume of the bypass chamber. The gas flow straightening devices 32 at each end of the bypass chamber 26 assure that the gas flow into the bypass chamber 26 at either end will be laminar. Therefore, a stable gas interface or transition layer will be maintained between the hot gas on the hot side 28 of the bypass chamber and the cold gas on the cold side 30. A temperature gradient will exist at the interface but the temperature gradient will be stable. One flow straightening device 32 which can be used is a series of spaced wire screens which provide no axial heat conduction path from the hot end 28 to the cold end 30 of the bypass chamber but which ensure gas flow in the chamber 26 is uniform. Other devices such as porous membranes or channelizing partitions may also be used.

A serendipitous concomitant effect of the bypass chamber 26 is the restriction of high temperatures to the heater, the hot end of the regenerator, and the hot end of the bypass chamber 26; all of the massive and moving components of the engine remain cool at all times. It is thus possible to build the cylinder head, engine block, and all of the moving parts of the engine with conventional low cost engine components using low cost materials and conventional manufacturing techniques. Only the heater and the hot sections of the bypass chamber and the regenerator need to be made of high temperature materials. This greatly reduces the cost of the engine because the cylinder head, which in all previous Stirling engine configurations is operated at high temperature, may now be made as inexpensively as an internal combustion engine cylinder head. Indeed, since the function of the cylinder head is now merely to close a cylinder and does not encounter the high temperature of prior Stirling engine, or the high pressure impulse of the internal combustion engine at point of ignition, the cylinder head might be made even less expensively than the internal combustion engine cylinder head. Moreover, since less metal mass need be heated to operating temperature, the cold start penalty of the inventive Stirling engine is reduced.

Figure 2:
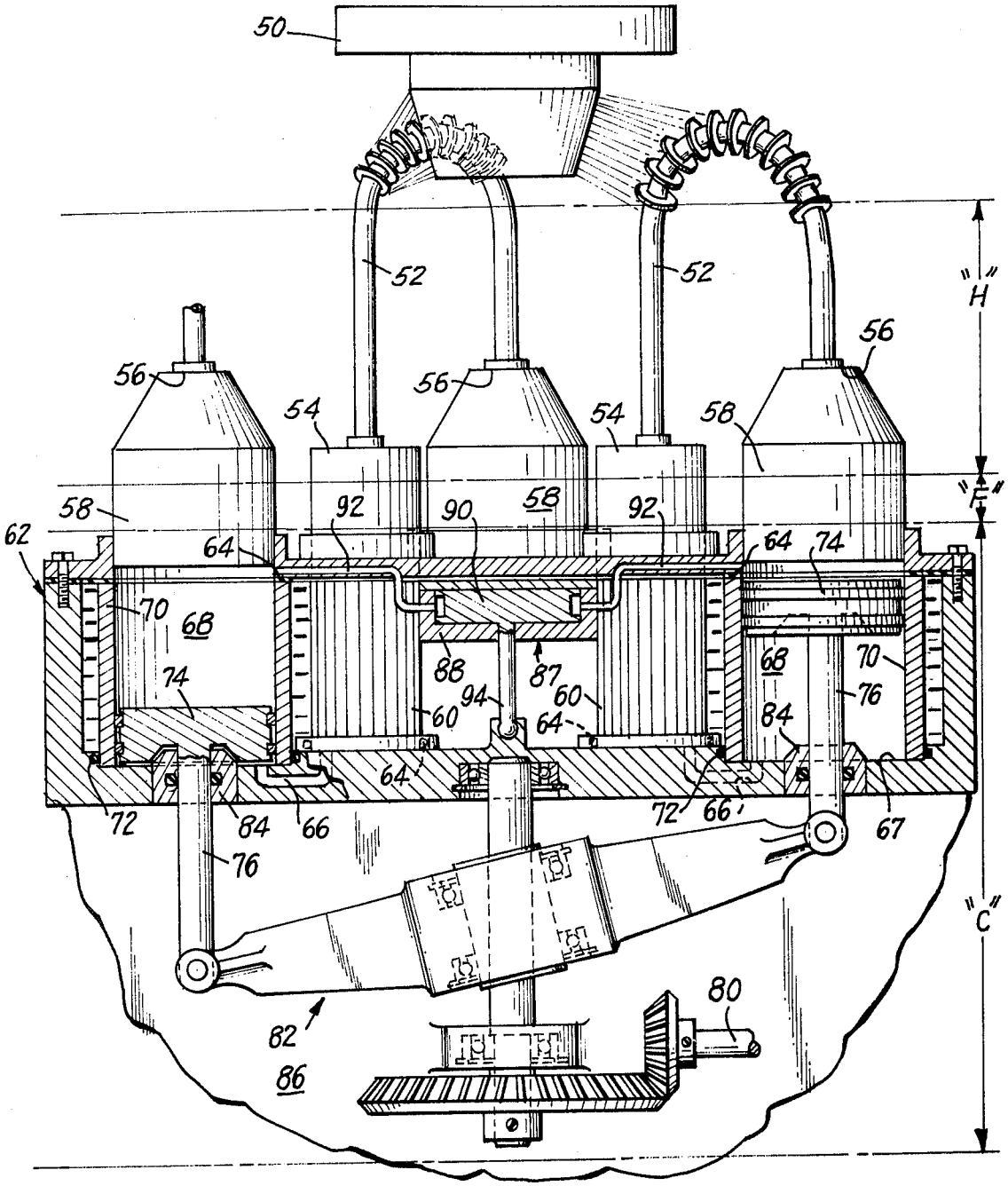
FIG. 2 is a sectional schematic elevation of a double-acting Stirling engine configuration incorporating the invention.
Figure 3:
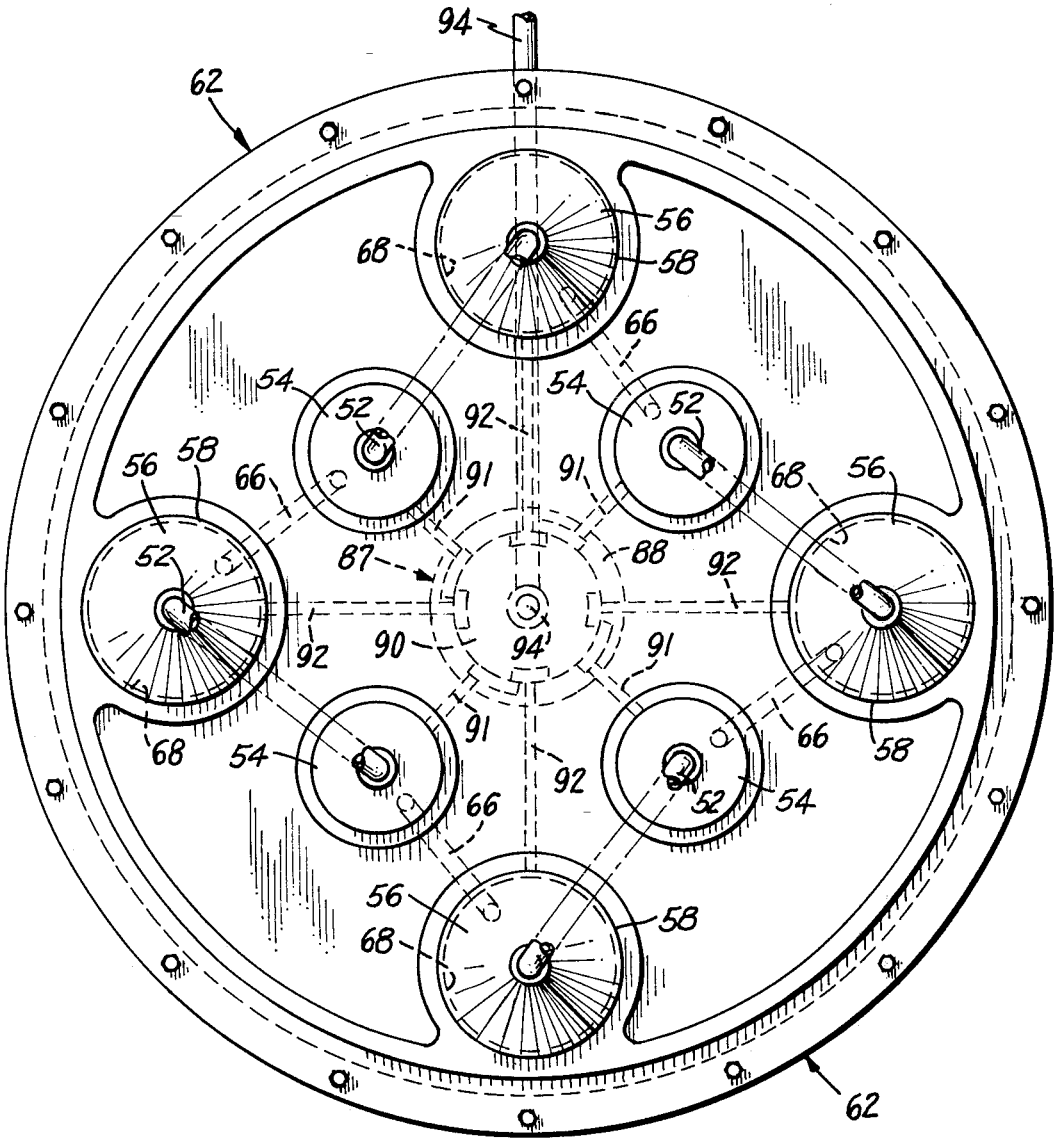
FIG. 3 is a plan view of the engine shown in FIG. 2.

A practical engine configuration which embodies the invention and profits from the advantages offered by this invention is shown in FIGS. 2 and 3. The engine includes a combustor 50 which heats a set of heater tubes 52 which run from a regenerator 54 of one cylinder to the hot end 56 of a bypass chamber 58 of the adjacent cylinder, as shown in the plan view of FIG. 3. Each of the heater tubes is in the form of an involute and extends in an angular and radial direction from a position axially aligned with one piston, radially inward and angularly displaced from that piston to the regenerator between it and the adjacent cylinder. A cooler 60 is axially aligned with and communicates directly with the regenerator 54. The regenerator 54 and the cooler 60 are in the form of the cooler and regenerator shown in the aforementioned copending application Ser. No. 168,075 of Folsom and Dineen filed on July 14, 1980.

The cooler 60 fits into a water jacket 62 and is sealed therein by suitable seals 64 provided for that purpose. A channel 66 in the floor 67 of the water jacket provides a communication between the lower end of the cooler 60 and the lower end of the adjacent gas cylinder 68. The cylinder 68 is defined by a cylinder liner 70 which fits into the water jacket 62 and is sealed therein by suitable seals 72. Gas motive means including a piston 74 having a piston rod 76 reciprocates axially in the cylinder liner 70 to circulate the working gas through the working space and to move under the influence of the pressure wave created thereby to produce output power. The reciprocating motion of the piston rod 76 is connected to rotating motion of the output power shaft 80 by a reciprocating-to-rotating motion conversion device 82 shown schematically as a wobble plate. A more complete disclosure of this device may be found in the said copending patent application Ser. No. 228,457 of John J. Dineen.

A seal housing 84 is mounted in the floor 67 of the water jacket 62 around the piston rod 76 to prevent leakage of high pressure working gas from the working space in the cylinder 68 into the crankcase 86.

A bypass valve 87 having a valve body 88 and a rotary valve member 90, corresponding to the valve 36 in the schematic diagram of FIG. 1, is mounted in the axial center of the engine adjacent to the junction of the regenerators 54 and coolers 60. In this manner, a separate gas line (although shown in FIG. 3 at 91 for clarity) is not necessary to connect the junction of the regenerators 54 and the coolers 60 to the valve 66; it is necessary only to provide an opening in the valve housing 88 at each quandrant of the regenerator/cooler junction into the valve body. Alternatively, the line 91 could be connected between the valve body 88 and other parts of the cold region of the gas flow paths such as at the lower end of the cooler. A gas line 92 corresponding to the gas conduit section 38 of FIG. 1 runs from the valve housing 88 to the top of each of the cylinders 68. Thus, the internal volume of the gas passages necessary to incorporate this invention is extremely small and indeed adds little to the dead volume of the engine.

A control rod 94 runs axially from the valve member 90, through the valve housing 88 and then radially outward between adjacent cylinders to a control device such as an automobile accelerator pedal.

The embodiment of FIG. 2 illustrates the heat isolating aspect of the invention. The hot region of the engine is restricted to the zone labeled "H" including the top of the regenerators 54, the hot end 56 of the bypass chamber 58, and the heater tubes 52. The region of the engine labeled "F" represents a fluctuating heat gradient in which the temperature of the gas and the related structure at any particular point in the zone fluctuates with the cycle of the engine. The region of the engine labeled "C" is cold at all times and is never exposed to the hot portion of the working gas. It is apparent that all moving parts and the majority of the metal mass and machined components are maintained cold at all times. The cost of the engine is greatly reduced. In addition, the region of the engine which is subjected to high frequency temperature cycles, and therefore subjected to thermal fatigue is limited to a short section of the bypass chamber and the regenerator which are simple monolithic parts that can be made at relatively low cost of high temperature materials. The hot region of the engine, that is, the top of the regenerator, the heater tubes, and the top of the bypass chamber, is maintained hot at all times and therefore, is not subject to thermal fatigue. In addition, these portions of the engine may be made of low mass or low heat capacity materials and therefore, the thermal inertia of this small section of the engine can be quite low thereby greatly reducing the cold start-up penalty of the Stirling engine, and reducing or eliminating altogether the period of "after-run" that is required to reduce the heat stored in the heater head of conventional Stirling engines.

The power control, in addition to the desirable thermal effect mentioned above, provides a fast-acting, effective, reliable and inexpensive power control for the Stirling engine enabling it to move in either direction between full power and zero power very quickly by the operation of the control member. Little force is required to effect the control movement and the control member can be easily spring biased toward the zero power position in the event of machine failure or operator incapacity. This is a "fixed charge" power control, so the complicated and expensive mean pressure control system is eliminated, and the inefficient pumping of heat into the cooler that occurs at low power or coasting conditions in the mean pressure controlled engines does not occur.

Obviously, numerous modifications and variations of the disclosed embodiment will occur to those skilled in the art in light of the foregoing description.

Therefore, it is expressly to be understood that these modifications and variations, and the equivalents thereof, may be practiced while remaining within the spirit and the scope of the invention as defined in the appended claims, wherein I claim:

1. A power control for a Stirling engine having a working space including an expansion space in which heated working gas can expand to produce power, and a compression space in which working gas can be compressed, said working space comprising the volume of a gas cylinder; a heater, a regenerator, and a cooler connected together in series; gas motive means movable in said cylinder for circulating a working gas from said expansion space, through said heater, said regenerator and said cooler and into said compression space, and then back again in a cyclic flow for producing a pressure wave in the working space, and also movable in said cylinder under the influence of said pressure wave for producing power; said power control comprising:

a bypass chamber for inhibiting thermal mixing of hot and cool working gas and having two ends, a first end communicating with said heater and a second end communicating with said expansion space of said cylinder;

a gas bypass conduit connecting the junction of said expansion space of said cylinder and said bypass chamber to said compression space so as to bypass at least said heater and regenerator; and an adjustable valve in said bypass conduit for controlling the proportion of gas flowing into said expansion space of said cylinder through said bypass conduit.

2. The power control defined in claim 1, wherein said bypass chamber is a conical shell having a wide end and a small end, said small end being connected to said heater and said wide end being connected to said expansion space and said bypass conduit is connected at the junction of said bypass chamber and said expansion space.

3. The power control defined in claim 1, further comprising:

means for laminarizing the flow of said gas to said bypass chamber to minimize the mixing of hot gas from said heater with cold gas from said compression space.

4. The power control defined in claim 1, wherein said Stirling engine is a multi-cylinder, double-acting engine having a bypass chamber for each of said cylinders; said valve is a single compound valve having a section for each cylinders, and includes actuating means for moving said valve to selected positions simultaneously and equally for each cylinder to select the proportion of working gas which is circulated through said heater and regenerator and which bypasses at least said heater and regenerator.

5. The power control defined in claim 4, wherein said control valve is a rotary valve disposed immediately beneath said bypass chamber and between two pairs of said cylinders.

6. The power control defined in claim 1, wherein said bypass chamber is coaxially disposed with respect to said cylinder.

7. The power control defined in claim 6, wherein said regenerator, in operation, has a hot portion and a cool portion, said hot portion being disposed adjacent to the junction of said heater and said regenerator and proximate said bypass chamber.

8. The power control defined in claim 7, wherein said regenerator has a cool portion at said junction of said cooler and said regenerator; said cool portion is disposed adjacent the connection between said bypass chamber and said expansion space and said cooler is disposed adjacent said working space; whereby said engine has a hot zone comprising said heater, a heat gradient portion comprising said regenerator and said bypass chamber, and a cool portion comprising said cooler and said working space and said piston, so that heat conduction losses are minimized.

9. In a Stirling engine having piston means movable in at least two cylinders, a first cylinder including a compression space and a second cylinder including an expansion space, for circulating a working gas through a gas flow path including a hot region which encompasses a heater and hot portions of a regenerator, and a cold region which encompasses cool portions of said regenerator and a cooler, for producing a pressure wave and for moving under the influence of said pressure wave to produce output power, a power control comprising:

a bypass chamber having two gas flow connections, a first connected to said expansion cylinder and a second connected to said heater and further including a hot gas end, a cool gas end and a gas interface section having a temperature gradient, said bypass chamber inhibiting the thermal mixing of hot and cold gas volumes in said heater and said expansion cylinder, respectively;

a conduit connecting said cold region of said gas flow path to said expansion cylinder;

a valve in said conduit to vary the proportion of working gas passing through said conduit;

whereby the amplitude of the cyclic flow through said regenerator and heater for each of all working cycles can be varied to vary the pressure amplitude in each cycle and thereby change the power output.

10. The power control defined in claim 9, wherein said bypass chamber is coaxially disposed with respect to said expansion cylinder.

11. The power control defined in claim 10, wherein said bypass chamber, in operation, has said hot end disposed adjacent to the junction of said heater, and said cool end disposed toward said expansion cylinder.

12. The power control defined in claim 9, wherein said bypass chamber has said cool end connected to said conduit, said cool end disposed adjacent the connection between said bypass chamber and said expansion cylinder; whereby said engine has a hot zone comprising said heater, a heat gradient portion comprising said regenerator and said bypass chamber, and a cool zone comprising said cooler, said compression and expansion cylinders and said piston means, so that said pistons means reciprocate in said cool zone.

13. The power control defined in claim 9 wherein said valve includes a single actuator which synchronizes and equalizes the valve openings in said conduits of all working cycles.

14. A method of modulating the power of a Stirling engine having a plurality of pistons disposed for reciprocation in a plurality of expansion and compression cylinders for circulating a charge of working gas through a closed gas flow path including said cylinders, a set of heat exchangers including a cooler, regenerator, and heater for each of said pistons, gas flow passages connecting in series said cylinders and said heat exchangers, and bypass means for connecting said cooler to said expansion cylinder, the method comprising:

producing output power from said engine by producing a pressure wave in the gas flow path and moving said pistons under the influence of said pressure wave;

bypassing a selected portion of said gas around said regenerator and said heater to reduce the output power of said engine; and causing said expansion and compression cylinders to be in a cool zone of said engine so that said pistons reciprocate in said cool zone.

* * * * *